United States Patent [19]

Baumgartner et al.

[11] Patent Number: 4,667,731

[45] Date of Patent: May 26, 1987

[54] COKE COOLER

[75] Inventors: Gary J. Baumgartner; Frank J. Jandrasi, both of Houston; Arthur J. Post, Jr., Cypress, all of Tex.

[73] Assignee: Triten Corporation, Houston, Tex.

[21] Appl. No.: 775,861

[22] Filed: Sep. 13, 1985

[51] Int. Cl.[4] ..... F28D 11/08

[52] U.S. Cl. ..... 165/88; 165/134.1; 29/157.3 R

[58] Field of Search ..... 165/87, 88, 90, 67; 202/227, 229; 432/83, 77, 235, 234, 237

[56] References Cited

U.S. PATENT DOCUMENTS

| | | | |
|---|---|---|---|
| 2,798,693 | 7/1957 | Bojner | 165/88 |
| 2,899,176 | 8/1959 | Francis et al. | 165/87 |
| 3,870,604 | 3/1975 | Wilt, Jr. | 202/227 |
| 3,917,516 | 11/1975 | Waldmann et al. | 432/80 X |
| 4,213,827 | 7/1980 | Calderon | 202/227 X |
| 4,557,804 | 12/1985 | Baumgartner et al. | 165/88 X |

*Primary Examiner*—Albert Davis, Jr.
*Assistant Examiner*—Richard R. Cole
*Attorney, Agent, or Firm*—Vaden, Eickenroht, Thompson & Boulware

[57] ABSTRACT

A bulk hot coke cooler with a vessel for holding the coolant material and a drum rotatably supported within the vessel so that when the drum rotates, it moves through the coolant, the drum having a plurality of hollow cooling pockets going from one side of the drum to the other which directly contact the hot coke in the drum through which pockets coolant can flow as the drum rotates to enhance the cooling effect of the coolant on the hot coke inside the drum, the pockets having end walls which close off the pockets forming an inlet and an outlet for the coolant, the drum wall not overlapping the pocket end wall. Transfer bars formed integrally of the pockets can be used to facilitate coke movement.

2 Claims, 11 Drawing Figures

COKE COOLER

BACKGROUND OF THE INVENTION

1. Field of the Invention

The present invention relates to coolers for hot bulk coke which cool by indirect heat exchange with a coolant such as water.

2. Description of the Prior Art

Coke is a useful by-product of the destructive distillation of coal or petroleum. In the production of coal gas, for example, hot coke is a by-product which must be cooled. A variety of methods and devices are available in the prior art for cooling hot glowing bulk coke discharged during distillation of coal or petroleum. Generally these cooling apparatuses involve a cylindrical drum rotating in a cooling bath, the drum holding the material to be cooled. The drum has means within it or is so mounted that the coke moves from an inlet end, the "hot end," to an outlet end, the "cold end." Temperatures at the hot end may be relatively high, such as 1400° C. while at the cold end relatively low, such as about 65° C.

We are aware of a variety of direct heat exchange devices such as those disclosed in U.S. Pat. Nos. 2,840,922; 2,841,883; and 3,050,868; but the prior art indirect heat exchange devices disclosed in U.S. Pat. Nos. 2,884,229; 2,899,176; and 3,917,516 are the closest prior art to our invention we are aware of. In addition to providing a cooling apparatus, each of the indirect heat exchangers in these references attempts to solve the problems associated with the intense heat encountered in cooling hot bulk material such as coke. None of their solutions is satisfactory.

In U.S. Pat. No. 2,884,229 longitudinally oriented hollow tubes with coolant flowing through them are used for indirect heat exchange. The tubes are shown to be of a consistent diameter, thickness and material composition throughout their length. In order to provide further cooling, a separate scoop is added at the end of each hollow tube to introduce more coolant into the tube. The addition of these scoops is expensive and inefficient and does not serve to reduce the wear of the hollow tubes at the inlet end of the drum due to the high temperature of the hot glowing coke nor do the scoops reduce damage at the outlet end of the tubes caused by the cooled coke which has hardened and so is highly abrasive.

In U.S. Pat. No. 2,899,176 crescent-shaped hollow "flights" are employed as the indirect heat exchange element. The flights are disposed through the rotating drum. Coolant flows through the flights and hot coke in the interior of the drum is contacted by the cooled interior surface of the flights. The flights are disclosed as having consistent thickness and dimensions throughout. The flights also are positioned so that they act as an internal conveying screw for the hot coke to move it from the hot end to the cold end of the drum. In order to provide an increase in heat exchange capability, each flight has an adjustable orifice which can be opened to permit more coolant to flow through the flight or to permit the coolant to flow more quickly through the flight. This adjustability feature, however, is not satisfactory for reducing the wear on the flights at the hot end of the cooler due to the high inlet temperature; nor does this adjustability feature have a salutary effect on the flights at the cold end of the cooler which are worn down by the abrasive action of the coke.

The cooler of U.S. Pat. No. 3,917,516 uses a plurality of cooling pockets as indirect heat exchange devices. Although this patent recognizes the problems associated with the substantial temperature differentials between both the exterior and interior of the rotating drum and the hot end and cold end of the drum, as well as the wearing problems of the pockets themselves, its solution of simply increasing material thickness in selected areas has not solved these problems in a satisfactory and practical manner.

The solution of U.S. Pat. No. 3,917,516 includes increasing the wall thickness of the rotating drum at the hot end to better withstand the high inlet temperature and increasing the wall thickness at the outlet end to better withstand the abrasive effect of the cooled coke. The fabrication of such a drum with thicknesses varying outwardly from an intermediate region to both ends is a significantly more complex and more expensive procedure than the fabrication of drums of other configurations. Also, when even the thickened portions wear out or wear through, a significant amount of downtime is required to replace or rebuild the work Parts, resulting in production losses.

U.S. Pat. No. 3,917,516 also proposes cooling pockets varying in height and width, depending on where they are located in the drum and, to protect the surfaces of the pocket turned towards the axis of the drum, angled metal aprons are attached to the pocket's surface. The pockets are disclosed as being of varying thicknesses depending on relative location in the drum. Since the material composition of the pockets does not vary no matter how thick they are, this approach attempts to solve both high temperature problems and abrasion problems by using more and more of the same material without regard for its suitability for solving one problem or the other.

SUMMARY OF THE PRESENT INVENTION

In pending U.S. application Ser. No. 611,777 there is disclosed a new coke cooler which uses new structures and materials to solve various problems encountered with the prior art coolers described above. The present invention is directed, among other things, to improvements in the subject matter of pending application Ser, No. 611,777 which subject matter is prior art to the present invention. The present invention also teaches a new system for moving the cooler and a new means for accessing the cooler's interior, as well as a new "taco shell" integral cooling pocket structure.

The present invention teaches improvements in coke coolers for combatting abrasion and high temperature, for facilitating maintenance and repair, and for increasing cooler efficiency. The present invention is directed to a coke cooling apparatus having a hollow rotor rotatably mounted in a coolant-containing vessel. The coke to be cooled is introduced at the inlet or hot end of the rotor and as the rotor rotates through the coolant, means are provided in the interior of the rotor for moving the coke to the outlet or cold end. Within the rotor itself further indirect heat exchange is provided by a plurality of hollow pockets through which coolant flows as the rotor is rotated. The pockets are made from heat and abrasion resistant material, eliminating the need for protective plates or wear sleeves for the surfaces of the pockets. The present invention also teaches a wheeled apparatus for moving the cooler, the apparatus having retractable wheel assemblies. The coolant-containing vessel according to the present invention has a movable opening for accessing or removing the rotor for maintenance and repair without having to disassemble the rotor. The pockets are integral structures which are inserted into arcuate openings in the rotor and then secured in place, for example by welding. The pockets may be fabricated from hardfaced plate and their edges may have a layer of hardfacing material sufficiently thick to eliminate the need for extra protective wear members. The use of these pockets greatly simplifies the construction of the coke cooler and makes it possible to produce a cooler which is more resistant to the abrasive effects of the hot coke.

It is therefore an object of the present invention to provide an improved hot bulk coke cooler.

It is a further object of the present invention to provide an improved cooler for hot coke which employs indirect heat exchange elements to effect cooling.

Another object of the present invention is the provision of a coke cooler having a rotor rotatably mounted in a coolant-containing vessel, the rotor having integral cooling pockets disposed and sealingly secured therein so that coolant can pass through the pockets, the pockets presenting heat exchange surface to the hot coke within the rotor.

Yet another object of the present invention is the provision of such a coke cooler in which the pockets are fabricated from sufficient amounts of heat-resistant or abrasion-resistant material such as hardfaced plate so that critical parts of the pocket do not need added protective shielding.

Another object of the present invention is the provision of a system for moving a coke cooler having wheel assemblies, including retractable wheel assemblies which can be activated when needed to facilitate cooler movement.

A particular object of the present invention is the provision of such a coke cooler in which the leading edges of the pockets are fabricated with an integral layer of hardfacing of sufficient thickness that protective wear members are unnecessary.

Another object of the present invention is the provision of such a coke cooler in which the vessel containing the rotor is openable for accessing or for removing the rotor.

Yet another object of the present invention is the provision of an integral or "taco shell" cooling pocket which facilitates the fabrication of the rotor and eliminates the path between the pocket and the rotor shell which exists in prior art devices. Such a path in the prior art devices Provides a way for abrasive material to wear away both rotor and pocket.

To one of skill in this art who has the benefit of the present invention's teachings, other and further objects, features and advantages will be apparent from the following description of the presently preferred embodiments of the invention, given for the purpose of disclosure, when taken in conjunction with the accompanying drawings.

Figure 1:
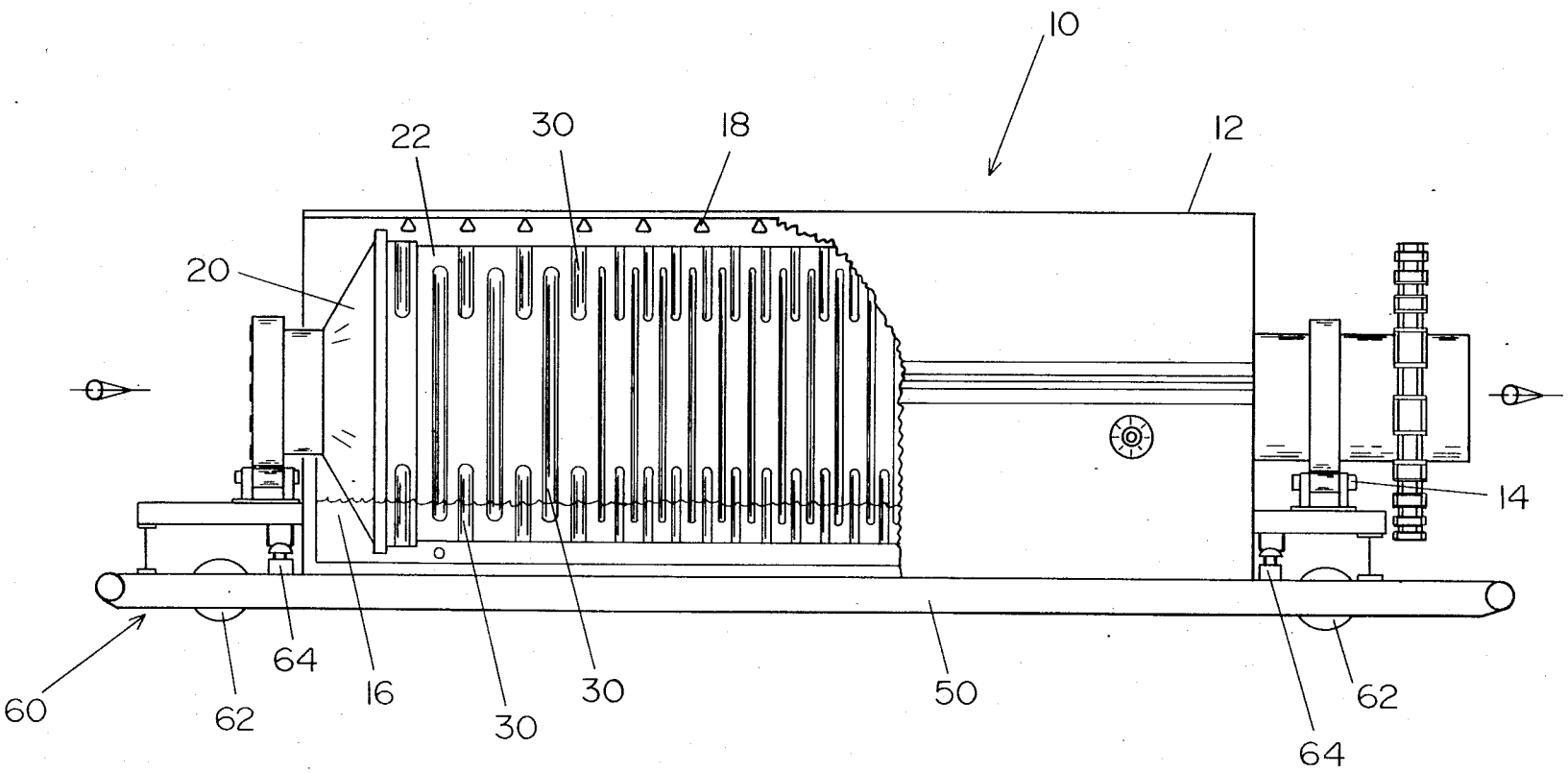
FIG. 1 is a side view partially cut away of a cooler according to the present invention.
Figure 2C:
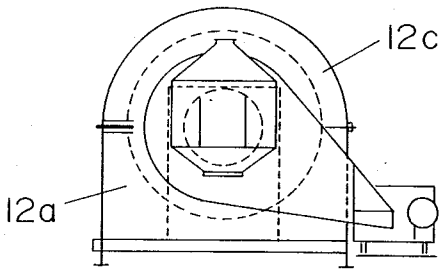
Figure 2D:
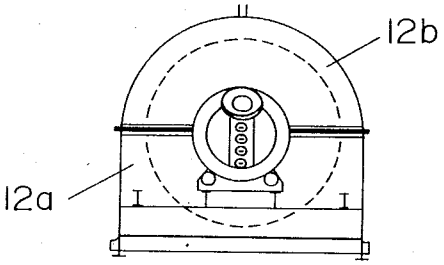
Figure 2A:
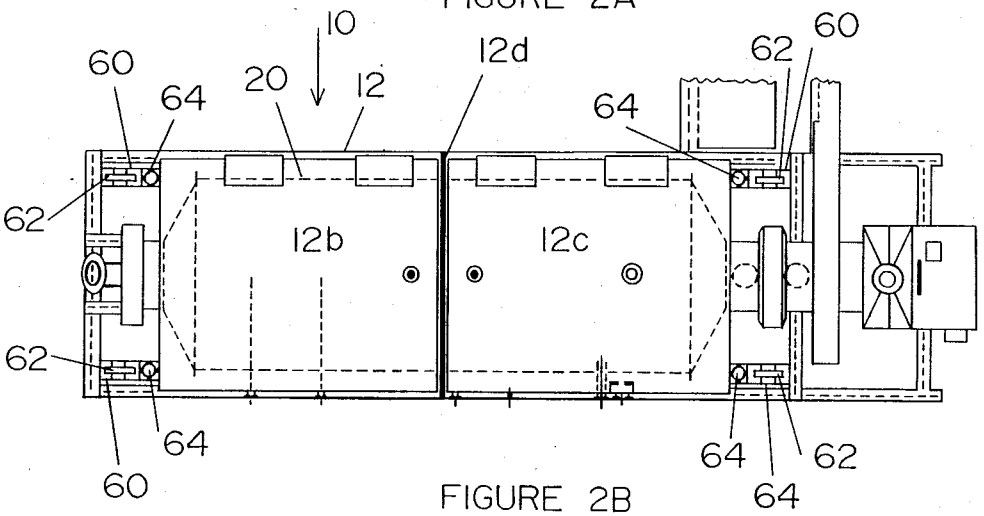
Figure 2B:
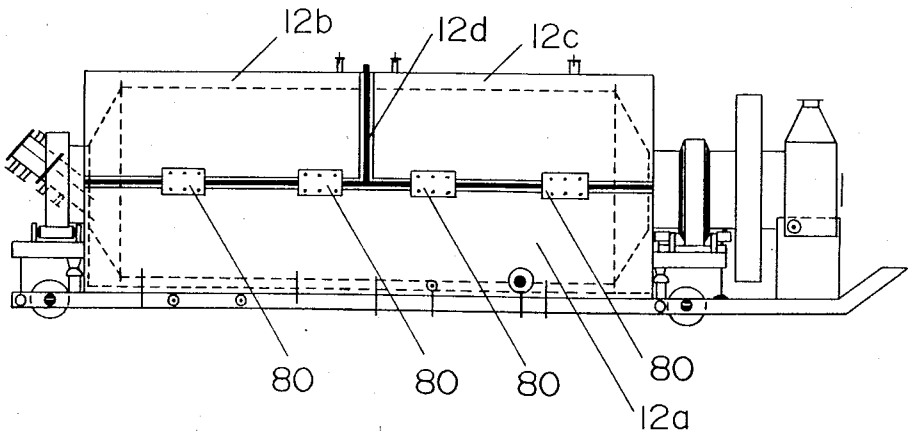

FIG. *2a* is a top view of the cooler of FIG. 1.

FIG. *2b* is a side view of the cooler of FIG. 1.

FIG. *2c* is a view of one end of the cooler of FIG. 1 and FIG. *2d* is a view of the other end.

Figure 3:
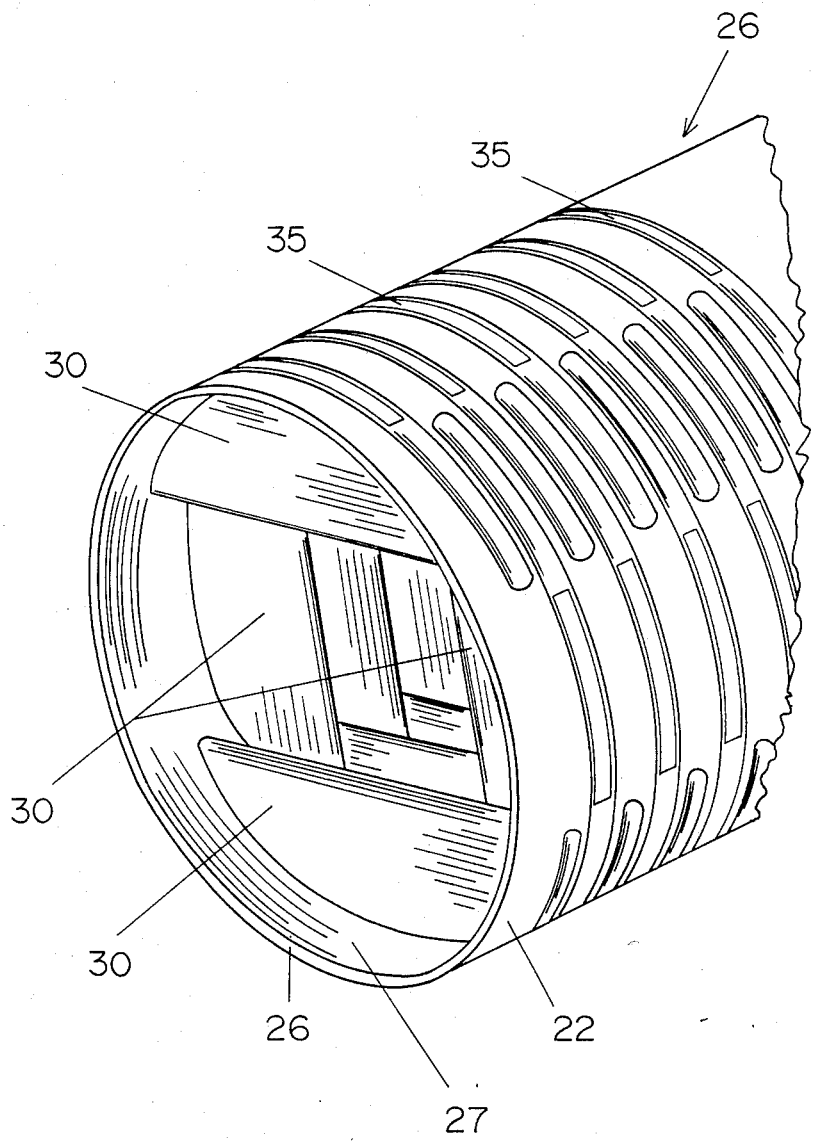

FIG. 3 is a partial end view of the rotor of the cooler of FIG. 1.

Figures 4A, 4B:
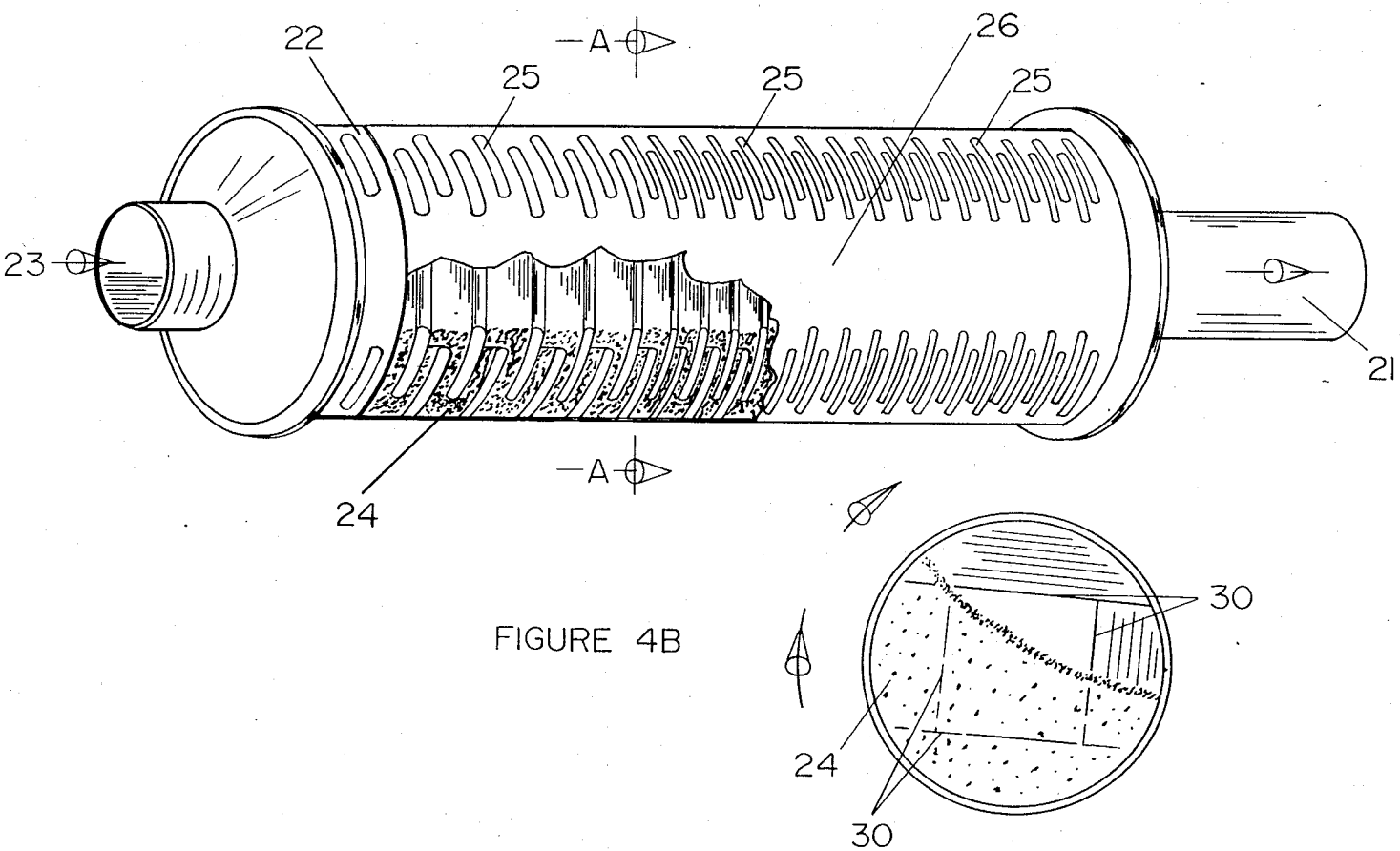

FIG. *4a and FIG. 4b* are a side view and a cross-sectional view of the rotor of FIGS. 1 and 3.

Figure 5:
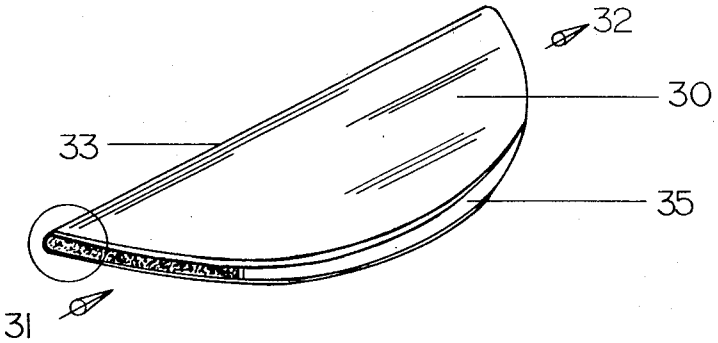

FIG. 5 is a perspective view of a pocket such as the pockets of FIG. 3.

Figure 6:
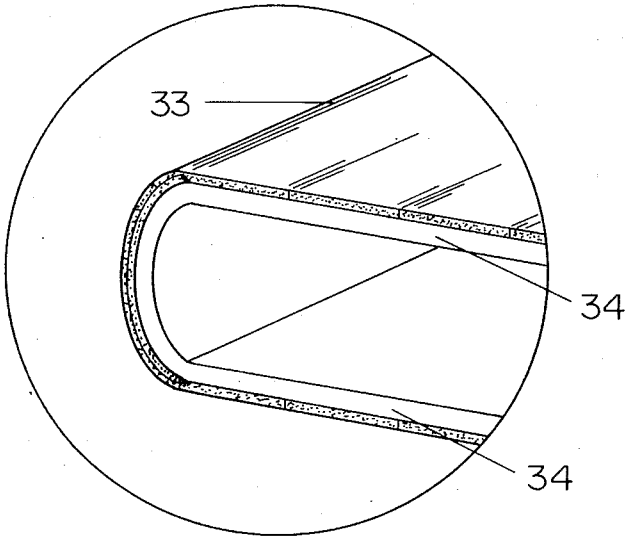

FIG. 6 is a perspective view of the leading edge of the pocket of FIG. 5.

Figure 7:
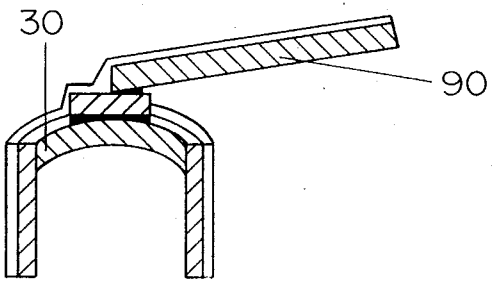

FIG. 7 is a cutaway view of a pocket's leading edge showing an integral transfer bar.

DESCRIPTION OF PREFERRED EMBODIMENTS

FIG. 1 illustrates a coke cooler 10 according to the present invention. The cooler 10 is mounted on a movable skid 50 which has four retractable wheels 62. The cooler 10 has a coolant containment vessel 12 with coolant such as water 16 in its bottom. The rotor 20 is rotatably mounted within the vessel 12. Spray nozzles 18 are mounted above the rotor 20 for spraying cooling water onto the rotor 20. It may be desirable to have more nozzles mounted above the rotor's hot inlet end than above the relatively cooler outlet end.

As shown in FIG. 2 there are four wheel assemblies 60 each having a wheel 62 and a hydraulic retracting/-projecting means 64. The hydraulic means 64 is mounted to the skid 50 beneath the rotative mountings for the rotor 20 so that the rotor load is passed to the wheels 62. By actuating the hydraulic means 64 (conventional actuating means not shown) the wheels 62 are projected downwardly, raising the skid 50 above the ground. The movement of the cooler is greatly facilitated in this way. After movement the wheels 62 can be retracted so that the skid 50 again rests on the ground.

The rotor 20 is shown in FIG. 4. The inlet or hot end 22 has a particle inlet 23 for receiving the hot bulk coke 24 which moves through the rotor 20. Each of the arcuate openings 25 in the rotor wall 26 is an opening for a pocket 30. Cooled coke particles exit the rotor 20 through the cool particle outlet 21. As shown in FIG. 3, a layer of hardfacing 27 can be applied to the rotor wall 26 to increase the resistance to temperature and to abrasion.

One of the cooling pockets 30 is illustrated in FIG. 5. Each pocket has an inlet 31 permitting the coolant 16 to flow through the pocket 30 and out the pocket outlet 32. Each pocket 30 is an integral structure comprised of walls 34 (which are preferably hardfaced plate), leading edge 33, and end walls 35. The pockets are similar to a taco shell with part of the opening closed off by the end wall 35. The end wall 35 extends from one wall 34 to the other wall 34, closing off part of the pocket's opening and forming the inlet 31 and the outlet 32. Since the pocket 30 is an integral structure, the fabrication of the rotor 20 is made much easier as compared to the fabrication of prior art rotors. A single opening is made in the rotor wall, the pocket is inserted, and is then welded in place.

As shown in FIGS. 3 and 4, arcuate openings 25 are provided in the wall 26 of the rotor 20. The taco shell pockets 30, which are completed integral structures, are inserted into these openings 25. It is much easier, as compared to the securing of pockets to rotors in the prior art, to secure a pocket 30 in an opening 25. The pockets 30 have walls 34 which project slightly beyond the exterior surface of the rotor wall 26; this fact and the continuous and relatively smooth geometry of the pocket-wall interface make it possible to weld the pockets in place with an acceptable weld from the outside of the rotor 20. Also, it is possible to access the pocket-wall interface from inside the rotor 20 so that the interior of the joint can have hardfacing applied to it. In prior art coolers two openings were cut in the rotor wall and a pocket was pushed through one opening and out the other and was then welded in place. This produced an area between the wall which was inaccessible for hardfacing and which was subject to wear. In the present invention one arcuate opening 25 is made in the wall 26 and the integral pocket 30 is inserted in the opening. The end wall 35 of the pocket in effect fills in part of the arcuate opening—there is no wall of the rotor covering the end wall 35, hence the unwanted wear path is eliminated.

As shown in FIG. 7 transfer bars 90, to facilitate movement of coke through the cooler, can be formed integrally of the ends of the pockets 30 by welding to facilitate movement of coke through the cooler. In the prior art these bars are affixed to protective wear sleeves which are in turn affixed to the pockets. Since, according to the present invention, protective wear sleeves are not necessary, the bars are formed integrally of the pocket. This avoids the problem of the wearing of the bar-sleeve connection. Also, in the prior art, wear and damage affecting the sleeve could affect the transfer bar. These problems are avoided since, in the present invention, no sleeves need to be used. The end of the plate 90 at the pocket does not extend beyond the pocket and the end can be protected with hardfacing. In the prior art, the extension beyond the pocket is exposed to wear.

As shown in FIGS. 5 and 6, the pockets 30 according to the present invention can be made without separate protective wear members to protect the pocket's leading edge. The leading edge 33 of the pocket 30 is comprised of hardfacing which is about three-eighths of an inch thick. The preferred hardfacing is commercially available Triten T200X. Using this hardfacing reduces or eliminates the need for wear sleeves, wear shields, or wear plates which are taught by the prior art. The walls 34 of the pocket 30 can be fabricated from hardfaced plates which then have had hardfacing applied to them.

Opening means are provided in the vessel 12 so that the rotor 20 can be removed as an integral piece from the vessel 12 or so that the rotor 20 can be worked on in place within the vessel 12. The opening means shown in FIGS. *2a–2d* includes a bottom 12*a* and two top segments 12*b* and 12*c*. The two top segments 12*b* and 12*c* can be bolted to the bottom segment 12*a* and to each other along the seam 12*d*. Also it is within the scope of this invention to provide hinges 80 (FIG. *2b*) to connect the top Sections 12*b* and 12*c* to the bottom Section 12*a* so that the two top sections can be hingedly moved to permit access to the rotor 20.

In conclusion, therefore, it is seen that the present invention and the embodiments disclosed herein are well adapted to carry out the objectives and obtain the ends set forth above. Certain changes can be made in the apparatus without departing from the spirit and scope of the invention as claimed below.

What is claimed is:

1. A bulk coke cooler comprising a vessel means containing coolant, rotor means rotatable about a horizontal axis in the vessel means while partially submerged in the coolant, the rotor means having inlet means at one end for receiving the hot bulk coke and outlet means at the other end through which the coke is discharged, a plurality of hollow cooling pockets each pocket being an integral structure and disposed in the rotor means so that as coolant enters and leaves the pockets the rotor means rotates through the coolant, and the wall of the rotor means forming no part of the pocket, and there being no overlap of the wall of the rotor means and the pocket wall.

2. A bulk coke cooler comprising vessel means containing coolant, hollow rotor means rotatable in the vessel means while particularly submerged in the coolant, the rotor means having inlet means at one end for receiving the hot bulk coke and outlet means at the other end through which the coke is discharged, a plurality of hollow cooling pockets mounted in the rotor means so that as the rotor means rotates through the coolant, coolant enters and leaves the pockets, the hollow cooling pockets being integral structures prior to their disposition and mounting in the rotor means, the wall of the rotor forming no part of the pockets, and there being no overlap of the wall of the rotor means and the pocket wall, at least one transfer bar on at least one pocket, the transfer bar connected directly to and formed integrally of the end of the pocket and disposed at an angle to the pocket for facilitating the movement of coke through the cooler.

* * * * *